US010451988B2

(12) United States Patent
Koyama

(10) Patent No.: US 10,451,988 B2
(45) Date of Patent: Oct. 22, 2019

(54) TONER AND IMAGE FORMING APPARATUS

(71) Applicant: KYOCERA Document Solutions Inc., Osaka (JP)

(72) Inventor: Akinori Koyama, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/142,060

(22) Filed: Sep. 26, 2018

(65) Prior Publication Data

US 2019/0107792 A1 Apr. 11, 2019

(30) Foreign Application Priority Data

Oct. 5, 2017 (JP) ..... 2017-194754

(51) Int. Cl.

| | |
|---|---|
| ***G03G 9/097*** | (2006.01) |
| ***G03G 15/00*** | (2006.01) |
| ***G03G 9/08*** | (2006.01) |
| ***G03G 5/082*** | (2006.01) |
| ***G03G 5/147*** | (2006.01) |

(52) U.S. Cl.

CPC ..... *G03G 9/09708* (2013.01); *G03G 5/08214* (2013.01); *G03G 5/14704* (2013.01); *G03G 9/0819* (2013.01); *G03G 9/09716* (2013.01); *G03G 9/09725* (2013.01); *G03G 15/75* (2013.01)

(58) Field of Classification Search

CPC ..... G03G 9/09708; G03G 9/09716; G03G 9/09725; G93G 21/0005; G93G 21/0058

USPC ..... 430/108.1, 108.6, 108.7

See application file for complete search history.

(56) References Cited

U.S. PATENT DOCUMENTS

| | | | | |
|---|---|---|---|---|
| 8,355,664 | B2 * | 1/2013 | Eiki | G03G 21/0011 399/349 |
| 10,303,074 | B2 * | 5/2019 | Yamawaki | G03G 9/09307 |
| 2008/0292983 | A1 | 11/2008 | Mizuhata et al. | |

FOREIGN PATENT DOCUMENTS

| | | | |
|---|---|---|---|
| WO | 2006/016643 | A1 | 2/2006 |

* cited by examiner

*Primary Examiner* — Janis L Dote

(74) *Attorney, Agent, or Firm* — Studebaker & Brackett PC

(57) ABSTRACT

A toner includes a plurality of toner particles each including a toner mother particle and an external additive adhering to a surface of the toner mother particle. The external additive includes hydrotalcite particles. The hydrotalcite particles have a number average primary particle diameter of at least 80 nm and no greater than 1,000 nm. The hydrotalcite particles have a volume resistivity of no greater than $1.0\times10^5$ Ω·cm. An amount of the hydrotalcite particles is at least 0.5 parts by mass and no greater than 3.0 parts by mass relative to 100 parts by mass of the toner mother particles.

6 Claims, 2 Drawing Sheets

TONER AND IMAGE FORMING APPARATUS

INCORPORATION BY REFERENCE

The present application claims priority under 35 U.S.C. § 119 to Japanese Patent Application No. 2017-194754, filed on Oct. 5, 2017. The contents of this application are incorporated herein by reference in their entirety.

BACKGROUND

The present disclosure relates to a toner and an image forming apparatus.

A known image forming apparatus includes an amorphous silicon photosensitive member.

SUMMARY

A toner according to a first aspect of the present disclosure includes a plurality of toner particles each including a toner mother particle and an external additive adhering to a surface of the toner mother particle. The external additive includes hydrotalcite particles. The hydrotalcite particles have a number average primary particle diameter of at least 80 nm and no greater than 1,000 nm. The hydrotalcite particles have a volume resistivity of no greater than $1.0\times10^5$ Ω·cm. An amount of the hydrotalcite particles is at least 0.5 parts by mass and no greater than 3.0 parts by mass relative to 100 parts by mass of the toner mother particles.

An image forming apparatus according to a second aspect of the present disclosure includes a photosensitive drum, an image forming section, a development device, and a transfer section. The photosensitive drum includes an amorphous silicon layer in a surface portion thereof. The image forming section forms an electrostatic latent image on the amorphous silicon layer. The development device develops the electrostatic latent image using a toner to form a toner image on the photosensitive drum. The transfer section transfers the toner image on the photosensitive drum to a recording medium. The toner is the toner according to the first aspect of the present disclosure.

DETAILED DESCRIPTION

Figure 1:
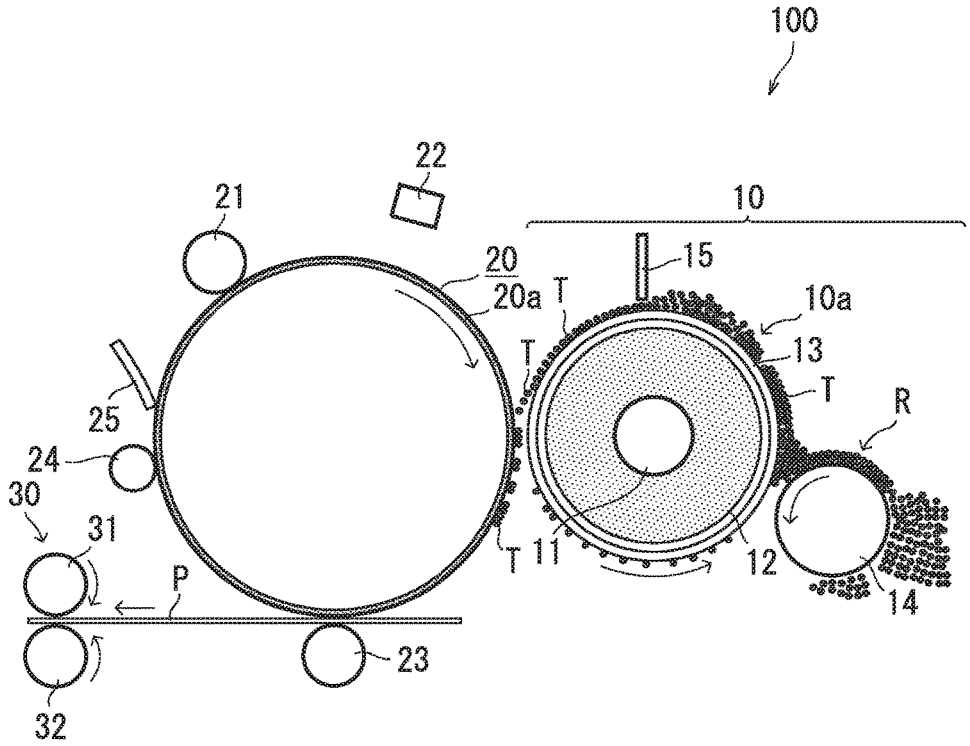
FIG. 1 is a diagram illustrating an image forming apparatus according to an embodiment of the present disclosure.

The following describes an embodiment of the present disclosure. Unless otherwise stated, evaluation results (for example, values indicating shape and physical properties) for particles (specific examples include toner mother particles, an external additive, and a toner) are each a number average of values measured for a suitable number of particles among the particles of interest.

A number average particle diameter of particles is a number average of equivalent circle diameters of primary particles (Heywood diameter: diameters of circles having the same areas as projected areas of the particles) measured using a microscope, unless otherwise stated. A value for a volume median diameter ($D_{50}$) of particles is measured using a laser diffraction/scattering particle size distribution analyzer ("LA-750", product of HORIBA, Ltd.), unless otherwise stated. Acid values and hydroxyl values are measured in accordance with "Japanese Industrial Standard (JIS) K0070-1992", unless otherwise stated.

Hereinafter, the term "-based" may be appended to the name of a chemical compound in order to form a generic name encompassing both the chemical compound itself and derivatives thereof. When the term "-based" is appended to the name of a chemical compound used in the name of a polymer, the term indicates that a repeating unit of the polymer originates from the chemical compound or a derivative thereof. The term "(meth) acryl" may be used as a generic term for both acryl and methacryl.

The term a "main component" of a material used herein refers to a component that accounts for the largest proportion of the mass of the material, unless otherwise stated. Chargeability refers to chargeability in triboelectric charging, unless otherwise stated. Strength of positive chargeability (or strength of negative chargeability) in triboelectric charging can be confirmed using for example a known triboelectric series.

In the present specification, the term "silica particles" is used to encompass both untreated silica particles (referred to below as a "silica base") and silica particles obtained by treating a surface of the silica base (which in other words are surface-treated silica particles). Silica particles hydrophobized using a surface treatment agent may be referred to as "hydrophobic silica particles". Silica particles rendered positively chargeable using a surface treatment agent may be referred to as "positively chargeable silica particles". The term "titanium oxide particles" is used to encompass untreated titanium oxide particles (referred to below as a "titanium oxide base"), titanium oxide particles obtained by treating a surface of the titanium oxide base (which in other words are "surface-treated titanium oxide particles"), and titanium oxide particles each having a conductive layer as a surface thereof. The term "hydrotalcite particles" is used to encompass untreated hydrotalcite particles (referred to below as a "hydrotalcite base"), hydrotalcite particles obtained by treating a surface of the hydrotalcite base (which in other words are "surface-treated hydrotalcite particles"), and hydrotalcite particles each having a conductive layer as a surface thereof. Hydrotalcite particles obtained by covering the hydrotalcite base with a conductive layer (which in other words are hydrotalcite particles rendered conductive by the conductive layer) may be referred to as "conductive hydrotalcite particles".

The following describes an image forming apparatus according to the present embodiment with reference to FIG. 1. As illustrated in FIG. 1, an image forming apparatus 100 includes a development device 10, a photosensitive drum 20, a charger 21, a light exposure device 22, a transfer roller 23, and a fixing device 30. The development device 10 includes a development roller 10*a* and a toner containing section R. The photosensitive drum 20 includes an amorphous silicon layer 20*a* in a surface portion thereof.

The charger 21 statically charges the amorphous silicon layer 20*a* of the photosensitive drum 20 in a uniform manner. The charger 21 is preferably a member that charges the amorphous silicon layer 20*a* by a contact charging process (for example, a roller, a brush, or a blade charged through application of an alternating current voltage or an alternating current voltage superimposed on a direct current voltage). The light exposure device 22 selectively irradiates the amorphous silicon layer 20*a* with light to form an electrostatic latent image after the amorphous silicon layer 20*a* is statically charged in a uniform manner by the charger 21. An LED head may for example be used as the light exposure device 22. The charger 21 and the light exposure device 22 form an electrostatic latent image on the amorphous silicon layer 20*a*. That is, in the image forming apparatus 100 illustrated in FIG. 1, the charger 21 and the light exposure device 22 are equivalent to what is referred to as an image forming section.

The toner containing section R of the development device 10 contains a developer. The developer is for example a magnetic toner including a plurality of toner particles T (a one-component developer: a developer containing no carrier). However, the developer is not limited to the one-component developer and may be a two-component developer.

A toner according to the present embodiment has the following features (referred to below as "basic features"). The image forming apparatus 100 according to the present embodiment contains the toner according to the present embodiment in the toner containing section R.

(Basic Features of Toner)

The toner includes a plurality of toner particles each including a toner mother particle and an external additive adhering to a surface of the toner mother particle. The external additive includes hydrotalcite particles. The hydrotalcite particles have a number average primary particle diameter of at least 80 nm and no greater than 1,000 nm. The hydrotalcite particles have a volume resistivity of no greater than $1.0\times10^5$ Ω·cm. An amount of the hydrotalcite particles is at least 0.5 parts by mass and no greater than 3.0 parts by mass relative to 100 parts by mass of the toner mother particles.

Figure 2:
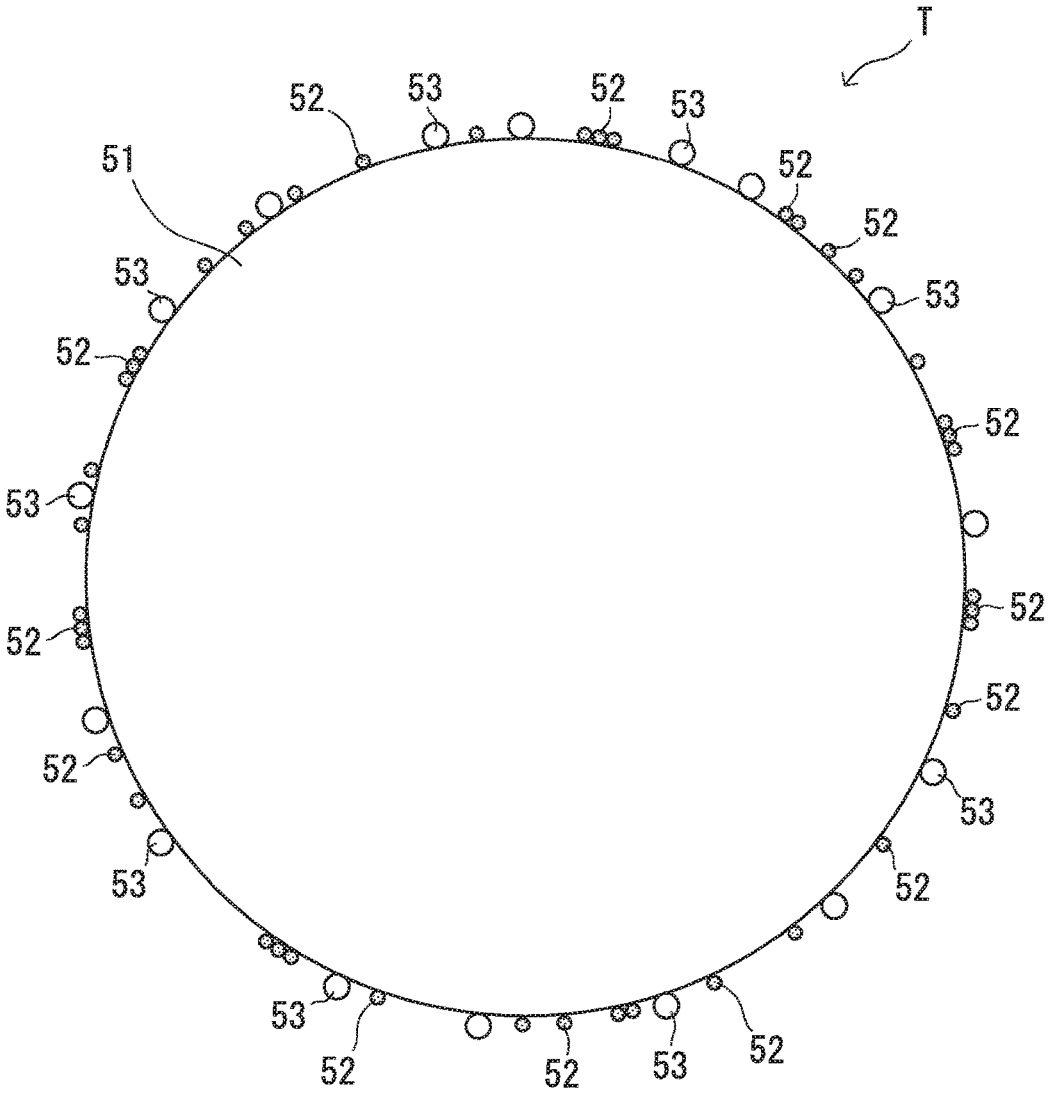
FIG. 2 is a diagram illustrating an example of a structure of a toner particle in a toner according to the embodiment of the present disclosure.

The following describes an example of a structure of the toner particles included in the toner having the above-described basic features with reference to FIG. 2. FIG. 2 is a diagram illustrating an example of a cross-sectional structure of a toner particle in the toner having the above-described basic features.

A toner particle T illustrated in FIG. 2 includes a toner mother particle 51, a plurality of silica particles 52, and a plurality of hydrotalcite particles 53. The silica particles 52 and the hydrotalcite particles 53 adhere to a surface of the toner mother particle 51. The silica particles 52 and the hydrotalcite particles 53 are caused to adhere to the surface of each toner mother particle 51 by for example stirring the toner mother particles 51, the silica particles 52, and the hydrotalcite particles 53 together. In the toner particle T illustrated in FIG. 2, for example, the silica particles 52 have a smaller number average primary particle diameter than the hydrotalcite particles 53.

The following further describes the image forming apparatus 100 with reference to FIG. 1. The development device 10 develops an electrostatic latent image using the toner to form a toner image on the photosensitive drum 20. Specifically, the development device 10 develops the electrostatic latent image by a one-component magnetic toner jumping development method. The image forming apparatus 100 may include a toner container for replenishing the toner containing section R of the development device 10 with the toner.

The development roller 10*a* includes a shaft 11, a magnet roll 12, and a hollow cylindrical development sleeve 13. The development sleeve 13 is supported rotatably around the shaft 11 (fixed shaft). The development roller 10*a* carries the toner supplied from the toner containing section R. The development device 10 further includes a toner supply roller 14 for supplying the toner from the toner containing section R to the development roller 10*a*. The toner supply roller 14 may also serve to stir the developer (magnetic toner). The development device 10 further includes a toner charging member 15 (for example, a doctor blade) for charging the toner carried on a surface of the development roller 10*a*. The toner charging member 15 may also serve to restrict an amount of the toner (thickness of a toner layer) on the development roller 10*a*. The toner charging member 15 is for example formed from a ferromagnetic material. The toner charging member 15 acts to press the toner (specifically, the magnetic toner) against the development sleeve 13. The toner is charged through friction with the development sleeve 13 or the toner charging member 15 in the development device 10 before being supplied to the photosensitive drum 20. For example, a positively chargeable toner is positively charged.

In a developing process, the toner (specifically, the charged toner) on the development sleeve 13 is supplied to the photosensitive drum 20 and selectively adheres to the electrostatic latent image, which in other words is a portion exposed to light, formed on the amorphous silicon layer 20*a* of the photosensitive drum 20 thereby to form the toner image on the amorphous silicon layer 20*a* of the photosensitive drum 20.

The transfer roller 23 is disposed opposite to the photosensitive drum 20. A conveyance path of a recording medium P is provided between the transfer roller 23 and the photosensitive drum 20. The recording medium P passes through the conveyance path between the transfer roller 23 and the photosensitive drum 20. A bias (voltage) is applied to the transfer roller 23 at a specific timing. Receiving the bias (voltage), the transfer roller 23 transfers the toner image on the photosensitive drum 20 to the recording medium P (specifically, the recording medium P between the photosensitive drum 20 and the transfer roller 23) by electric force (specifically, a potential difference between the photosensitive drum 20 and the recording medium P). That is, in the image forming apparatus 100 illustrated in FIG. 1, the transfer roller 23 is equivalent to what is referred to as a transfer section.

The fixing device 30 includes a first roller 31 (for example a heating roller including a heater) and a second roller 32 (for example, a non-heating roller including no heater). The fixing device 30 holds the recording medium P between the first roller 31 and the second roller 32 with the first roller 31 in contact with the toner image (specifically, the toner image transferred onto the recording medium P in a transfer process) on a front side (a side toward the photosensitive drum 20) of the recording medium P and the second roller 32 in contact with a back side of the recording medium P to fix the toner image to the recording medium P.

The image forming apparatus 100 further includes a cleaning blade 25 for removing unnecessary toner on the photosensitive drum 20. The cleaning blade 25 removes residual toner adhering to a surface of the photosensitive drum 20 after the transfer process.

The image forming apparatus 100 further includes a polishing member 24 for polishing the surface of the photosensitive drum 20. Specifically, the polishing member 24 is a rubbing roller that rubs against the surface of the photosensitive drum 20. The polishing member 24 is located downstream of the transfer roller 23 (the transfer section) in a rotation direction of the photosensitive drum 20. The polishing member 24 (specifically, the rubbing roller) for example has a structure including a metal shaft and an elastic member, such as urethane foam, covering a surface of the metal shaft. The polishing member 24 is rotatable while in contact with the surface of the photosensitive drum 20. The residual toner on the surface of the photosensitive drum 20 moves to a surface of a roller of the polishing member 24. As a result, a toner layer having a uniform thickness is formed on the surface of the roller of the polishing member 24. The toner layer includes the hydrotalcite particles (external additive). The hydrotalcite particles function as an abrasive. The polishing member 24 rubs against the surface of the photosensitive drum 20 with the toner adhering to the surface of the roller, and thus polishes the surface of the photosensitive drum 20 using the hydrotalcite particles in the toner adhering to the surface of the roller as an abrasive. Preferably, a rotational speed of the roller of the polishing member 24 is higher than a rotational speed of the photosensitive drum 20. Such a rotational speed difference ensures that the polishing member 24 adequately polishes the surface of the photosensitive drum 20. The polishing member 24 removes ionic products that adhere to the surface of the photosensitive drum 20 during image formation by polishing the surface of the photosensitive drum 20.

The development device 10 in the image forming apparatus 100 according to the present embodiment develops an electrostatic latent image using the toner having the above-described basic features to form a toner image on the photosensitive drum 20. The toner having the above-described basic features is contained in the toner containing section R. The toner having the above-described basic features includes the hydrotalcite particles as an external additive of the toner particles. Hydrotalcite can be represented by formula (1) shown below.

$$M_{1-x}^{2+}M_x^{3+}(OH)_2A_{(x/n)}^{n-}\cdot mH_2O \quad (1)$$

In formula (1), $M^{2+}$ represents a divalent metal ion, and $M^{3+}$ represents a trivalent metal ion. $M^{2+}$ is preferably at least one divalent metal ion selected from the group consisting of $Mg^{2+}$, $Zn_{2+}$, $Ca^{2+}$, $Ba^{2+}$, $Ni^{2+}$, $Sr^{2+}$, $Cu^{2+}$, and $Fe^{2+}$, and is particularly preferably $Mg^{2+}$ or $Zn^{2+}$. $M^{3+}$ is preferably at least one trivalent metal ion selected from the group consisting of $Al^{3+}$, $B^{3+}$, $Ga^{3+}$, $Fe^{3+}$, $Co^{3+}$, and $In^{3+}$, and is particularly preferably $Al^{3+}$ or $Fe^{3+}$. In formula (1), x represents a numerical value greater than 0.00 and less than or equal to 0.50, and m represents a numerical value greater than or equal to 0. That is, m may be 0. In terms of producibility of hydrotalcite, it is particularly preferable that both "$0.10 \leq x \leq 0.33$" and "$0.1 \leq m \leq 5.0$" are satisfied. $A^{n-}$ represents an n-valent anion. $A^{n-}$ is preferably at least one anion selected from the group consisting of $CO_3^{2-}$, $OH^-$, $Cl^-$, $I^-$, $F^-$, $Br^-$, $SO_4^{2-}$, $HCO_3^-$, $CH_3COO^-$, and $NO^{3-}$, and is particularly preferably $CO_3^{2-}$, $Cl^-$, or $NO^{3-}$.

Hydrotalcite includes positively charged base layers $[M^{2+}_{1-x}M^{3+}_x(OH)_2]^{x+}$ and a negatively charged interlayer $[A^{n-}_{(x/n)}\cdot mH_2O]^{x-}$. Hydrotalcite has the ability to adsorb ionic materials. For example, hydrotalcite has anion exchange capabilities. Specifically, $A^{n-}$ is replaced with an anion. Hydrotalcite therefore functions as an anionic adsorbent.

The polishing member 24 in the image forming apparatus 100 according to the present embodiment is in contact with the surface of the photosensitive drum 20 to polish the surface of the photosensitive drum 20 using the hydrotalcite particles as an abrasive. As mentioned above, hydrotalcite has the ability to adsorb ionic materials. It is therefore possible to readily remove ionic materials that adhere to the surface of the photosensitive drum 20 during image formation (particularly, discharge products that are produced when the amorphous silicon layer 20*a* of the photosensitive drum 20 is charged) by polishing the surface of the photosensitive drum 20 using the hydrotalcite particles as an abrasive. Ionic materials are removed by adsorption as well as by polishing. The hydrotalcite particles are more effective than titanium oxide particles in terms of removal of ionic materials present on the surface of the photosensitive drum 20 (see toners TA-1 and TB-6 described below). Since ionic materials present on the surface of the photosensitive drum 20 are adequately removed, image deletion (specifically, a phenomenon described as blurring of an image that looks as if the image was smeared) is inhibited, and the lifetime of the amorphous silicon photosensitive drum is extended. Furthermore, ionic materials present on the surface of the photosensitive drum 20 can be adequately removed even if the external additive does not include titanium oxide particles so long as the external additive includes the hydrotalcite particles. However, the external additive may include both the hydrotalcite particles and the titanium oxide particles.

In order that the polishing member 24 polishes the surface of the photosensitive drum 20 using the hydrotalcite particles as an abrasive, the toner preferably includes the hydrotalcite particles in an amount of at least 0.5 parts by mass and no greater than 3.0 parts by mass relative to 100 parts by mass of the toner mother particles, and the hydrotalcite particles preferably have a number average primary particle diameter of at least 80 nm and no greater than 1,000 nm. In a situation in which the hydrotalcite particles have an excessively small number average primary particle diameter, the toner is transferred from the photosensitive drum 20 to the recording medium P with many of the hydrotalcite particles remaining on the toner particles in the transfer process. In such a situation, therefore, it is difficult to supply a sufficient amount of the hydrotalcite particles to the polishing member 24. In a situation in which the hydrotalcite particles have an excessively large number average primary particle diameter, many of the hydrotalcite particles are detached from the toner particles before the toner moves from the development roller 10*a* to the photosensitive drum 20. In such a situation, therefore, it is difficult to supply a sufficient amount of the hydrotalcite particles to the polishing member 24. It is possible to detach an appropriate amount of the hydrotalcite particles from the toner particles on the surface of the photosensitive drum 20 and supply a sufficient amount of the hydrotalcite particles to the polishing member 24 so long as the hydrotalcite particles have a number average primary particle diameter of at least 80 nm and no greater than 1,000 nm. In order to inhibit image deletion, particularly preferably, the toner includes the hydrotalcite particles in an amount of at least 2.0 parts by mass and no greater than 3.0 parts by mass relative to 100 parts by mass of the toner mother particles. In a situation in which the amount of the hydrotalcite particles in the toner is excessively large, fogging is likely to occur (see a toner TB-2 described below).

In the case of the positively chargeable toner, the transfer roller 23 is negatively charged oppositely to the toner and attracts the toner by electrostatic force in the transfer process. In a situation in which the hydrotalcite particles are also positively chargeable, the toner is transferred from the photosensitive drum 20 to the recording medium P with many of the hydrotalcite particles remaining on the toner particles in the transfer process. In such a situation, therefore, it is difficult to supply a sufficient amount of the hydrotalcite particles to the polishing member 24. In order to ensure that a sufficient amount of the hydrotalcite particles are present on the surface of the photosensitive drum 20 after the transfer process, it is preferable to use hydrotalcite particles subjected to a surface treatment to impart sufficient negative chargeability (also referred to below as a "negative chargeability imparting treatment"). Particularly preferably, a silazane compound is used as a surface treatment agent for the negative chargeability imparting treatment.

It has been difficult to continuously form high-quality images over a long period of time by merely using generic hydrotalcite particles (specifically, hydrotalcite particles having high electric resistance) as an external additive of the toner particles. Specifically, hydrotalcite particles having an excessively high volume resistivity are likely to be excessively charged and stay on the surface of the photosensitive drum 20. Such hydrotalcite particles may cause dielectric breakdown upon application of voltage thereto, damaging the photosensitive drum 20. Damage in the photosensitive drum 20 causes black spots to be formed on the recording medium P. The inventor of the present disclosure solved the above-described problem by restricting the volume resistivity of the hydrotalcite particles to $1.0\times10^5$ Ω·cm or lower. The hydrotalcite particles having sufficiently low electric resistance tend not to be excessively charged. In order that the hydrotalcite particles have a sufficiently low volume resistivity, the hydrotalcite particles preferably include a hydrotalcite base and a conductive layer present on a surface of the hydrotalcite base. The conductive layer may cover the surface of the hydrotalcite base entirely or partially. Particularly preferably, the conductive layer is an indium tin oxide layer. In terms of producibility of the hydrotalcite particles, the volume resistivity of the hydrotalcite particles is preferably at least $1.0\times10^1$ Ω·cm and no greater than $1.0\times10^5$ Ω·cm.

Particularly preferably, the external additive of the toner having the above-described basic features further includes silica particles having a number average primary particle diameter of at least 5 nm and no greater than 30 nm. Silica particles having a small diameter tend to impart fluidity to the toner. However, silica particles having a small diameter are easily embedded in the toner mother particles by external force. In the toner having the above-described basic features, the hydrotalcite particles having a larger particle diameter (specifically, hydrotalcite particles having a number average primary particle diameter of at least 80 nm and no greater than 1,000 nm) present on the surfaces of the toner mother particles reduce exertion of stress on the silica particles, preventing the silica particles from being embedded in the toner mother particles.

Although the image forming apparatus 100 including the polishing member 24 is illustrated as an example in FIG. 1, the present disclosure is also applicable to an image forming apparatus having the same configuration as the image forming apparatus 100 illustrated in FIG. 1 except for lacking the polishing member 24. In such an image forming apparatus, the hydrotalcite particles are supplied to the cleaning blade 25 and become held between the photosensitive drum 20 and the cleaning blade 25 to act to remove ionic materials present on the surface of the photosensitive drum 20.

Although the image forming apparatus 100 that forms images using a magnetic toner is illustrated as an example in FIG. 1, the present disclosure is also applicable to an image forming apparatus that forms images using a non-magnetic toner. A two-component developer can be prepared by mixing a non-magnetic toner with a magnetic carrier (for example, a ferrite carrier).

The toner particles included in the toner may be toner particles having no shell layers (referred to below as non-capsule toner particles) or may be toner particles having shell layers (referred to below as capsule toner particles). In each of the capsule toner particles, a toner mother particle includes a core and a shell layer covering a surface of the core. The shell layers are substantially composed of a resin. Both heat-resistant preservability and low-temperature fixability of the toner can be achieved for example by using low-melting cores and covering each core with a highly heat-resistant shell layer. An additive may be dispersed in the resin composing the shell layers. Each shell layer may cover the surface of the corresponding core entirely or partially. The shell layers may be substantially composed of a thermosetting resin, may be substantially composed of a thermoplastic resin, or may contain both a thermoplastic resin and a thermosetting resin. The shell layers may be formed by any method. For example, the shell layers may be formed by any of in-situ polymerization, in-liquid curing film coating, and coacervation.

The following describes a preferable example of a composition of non-capsule toner particles. The toner mother particles and the external additive are described in the stated order. Non-essential components may be omitted in accordance with the intended use of the toner. The following toner mother particles of the non-capsule toner particles can be used as cores for capsule toner particles.

[Toner Mother Particles]

The toner mother particles contain a binder resin. The toner mother particles may contain an internal additive (for example, at least one of a releasing agent, a colorant, a charge control agent, and a magnetic powder) as necessary. In order to obtain a toner suitable for image formation, the toner mother particles preferably have a volume median diameter ($D_{50}$) of at least 4 μm and no greater than 9 μm.

(Binder Resin)

Typically, the binder resin is a main component of the toner. In a preferable example of a magnetic toner containing a magnetic powder, the binder resin accounts for approximately 60% by mass of the toner mother particles. In a preferable example of a non-magnetic toner containing no magnetic powder, the binder resin accounts for approximately 85% by mass of the toner mother particles. Accordingly, properties of the binder resin are thought to have a great influence on overall properties of the toner mother particles. Properties (specific examples include hydroxyl value, acid value, Tg, and Tm) of the binder resin can be adjusted by using different resins in combination for the binder resin.

The binder resin is preferably a polyester resin, and particularly preferably a polyester resin having an acid value of at least 5 mgKOH/g and no greater than 20 mgKOH/g.

A polyester resin can be synthesized through polycondensation of at least one polyhydric alcohol with at least one polycarboxylic acid. Examples of alcohols that can be preferably used for synthesis of a polyester resin include the following dihydric alcohols (specific examples include aliphatic diols and bisphenols) and tri- or higher-hydric alcohols. Examples of carboxylic acids that can be preferably used for synthesis of a polyester resin include the following dibasic carboxylic acids and tri- or higher-basic carboxylic acids.

Examples of preferable aliphatic diols include diethylene glycol, triethylene glycol, neopentyl glycol, 1,2-propanediol, α,ω-alkanediols (specific examples include ethylene glycol, 1,3-propanediol, 1,4-butanediol, 1,5-pentanediol, 1,6-hexanediol, 1,7-heptanediol, 1,8-octanediol, 1,9-nonanediol, and 1,12-dodecanediol), 2-butene-1,4-diol, 1,4-cyclohexanedimethanol, dipropylene glycol, polyethylene glycol, polypropylene glycol, and polytetramethylene glycol.

Examples of preferable bisphenols include bisphenol A, hydrogenated bisphenol A, bisphenol A ethylene oxide adduct, and bisphenol A propylene oxide adduct.

Examples of preferable tri- or higher-hydric alcohols include sorbitol, 1,2,3,6-hexanetetraol, 1,4-sorbitan, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, trimethylolethane, trimethylolpropane, and 1,3,5-trihydroxymethylbenzene.

Examples of preferable dibasic carboxylic acids include aromatic dicarboxylic acids (specific examples include phthalic acid, terephthalic acid, and isophthalic acid), α,ω-alkane dicarboxylic acids (specific examples include malonic acid, succinic acid, adipic acid, suberic acid, azelaic acid, sebacic acid, and 1,10-decanedicarboxylic acid), alkyl succinic acids (specific examples include n-butylsuccinic acid, isobutylsuccinic acid, n-octylsuccinic acid, n-dodecylsuccinic acid, and isododecylsuccinic acid), alkenyl succinic acids (specific examples include n-butenylsuccinic acid, isobutenylsuccinic acid, n-octenylsuccinic acid, n-dodecenylsuccinic acid, and isododecenylsuccinic acid), maleic acid, fumaric acid, citraconic acid, itaconic acid, glutaconic acid, and cyclohexanedicarboxylic acid.

Examples of preferable tri- or higher-basic carboxylic acids include 1,2,4-benzenetricarboxylic acid (trimellitic acid), 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, and EMPOL trimer acid.

A preferable example of the polyester resin is a polymer of monomers (resin raw materials) including at least one α,ω-alkanediol (for example, ethylene glycol), at least one aromatic dicarboxylic acid (for example, terephthalic acid), and at least one tri- or higher-basic carboxylic acid (for example, trimellitic acid).

The toner mother particles may contain, as the binder resin, a resin other than the polyester resin. Examples of resins that can be preferably used as the binder resin other than the polyester resin include thermoplastic resins such as styrene-based resins, acrylic acid-based resins (specific examples include acrylic acid ester polymers and methacrylic acid ester polymers), olefin-based resins (specific examples include polyethylene resins and polypropylene resins), vinyl chloride resins, polyvinyl alcohols, vinyl ether resins, N-vinyl resins, polyamide resins, and urethane resins. Furthermore, copolymers of the resins listed above, that is, copolymers obtained through incorporation of a repeating unit into any of the resins listed above (specific examples include styrene-acrylic acid-based resins and styrene-butadiene-based resins) may be preferably used as the binder resin.

(Colorant)

The toner mother particles may contain a colorant. A known pigment or dye matching a color of the toner can be used as a colorant. In order to obtain a toner suitable for image formation, the amount of the colorant is preferably at least 1 part by mass and no greater than 20 parts by mass relative to 100 parts by mass of the binder resin.

The toner mother particles may contain a black colorant. Carbon black can for example be used as a black colorant. Alternatively, a colorant that is adjusted to a black color using a yellow colorant, a magenta colorant, and a cyan colorant can be used as a black colorant. A magnetic powder described below may be used as the black colorant. That is, the toner mother particles do not need to contain a colorant other than the magnetic powder.

The toner mother particles may contain a non-black colorant such as a yellow colorant, a magenta colorant, or a cyan colorant.

The yellow colorant that can be used is for example at least one compound selected from the group consisting of condensed azo compounds, isoindolinone compounds, anthraquinone compounds, azo metal complexes, methine compounds, and arylamide compounds. Examples of yellow colorants that can be preferably used include C.I. Pigment Yellow (3, 12, 13, 14, 15, 17, 62, 74, 83, 93, 94, 95, 97, 109, 110, 111, 120, 127, 128, 129, 147, 151, 154, 155, 168, 174, 175, 176, 180, 181, 191, or 194). Naphthol Yellow S, Hansa Yellow G, and C.I. Vat Yellow.

The magenta colorant that can be used is for example at least one compound selected from the group consisting of condensed azo compounds, diketopyrrolopyrrole compounds, anthraquinone compounds, quinacridone compounds, basic dye lake compounds, naphthol compounds, benzimidazolone compounds, thioindigo compounds, and perylene compounds. Examples of magenta colorants that can be preferably used include C.I. Pigment Red (2, 3, 5, 6, 7, 19, 23, 48:2, 48:3, 48:4, 57:1, 81:1, 122, 144, 146, 150, 166, 169, 177, 184, 185, 202, 206, 220, 221, or 254).

The cyan colorant that can be used is for example at least one compound selected from the group consisting of copper phthalocyanine compounds, anthraquinone compounds, and basic dye lake compounds. Examples of cyan colorants that can be preferably used include C.I. Pigment Blue (1, 7, 15, 15:1, 15:2, 15:3, 15:4, 60, 62, or 66), Phthalocyanine Blue, C.I. Vat Blue, and C.I. Acid Blue.

(Releasing Agent)

The toner mother particles may contain a releasing agent. The releasing agent is for example used in order to improve fixability or offset resistance of the toner. In order to improve fixability or offset resistance of the toner, the amount of the releasing agent is preferably at least 1 part by mass and no greater than 30 parts by mass relative to 100 parts by mass of the binder resin.

Examples of releasing agents that can be preferably used include: aliphatic hydrocarbon waxes such as low molecular weight polyethylene, low molecular weight polypropylene, polyolefin copolymer, polyolefin wax, microcrystalline wax, paraffin wax, and Fischer-Tropsch wax; oxides of aliphatic hydrocarbon waxes such as polyethylene oxide wax and block copolymer of polyethylene oxide wax; plant waxes such as candelilla wax, carnauba wax, Japan wax, jojoba wax, and rice wax; animal waxes such as beeswax, lanolin, and spermaceti; mineral waxes such as ozocerite, ceresin, and petrolatum, waxes having a fatty acid ester as a main component such as montanic acid ester wax and castor wax; and waxes in which a part or all of a fatty acid ester has been deoxidized such as deoxidized carnauba wax. One releasing agent may be used independently, or two or more releasing agents may be used in combination.

(Charge Control Agent)

The toner mother particles may contain a charge control agent. The charge control agent is for example used in order to improve charge stability or a charge rise characteristic of the toner. The charge rise characteristic of the toner is an indicator as to whether the toner can be charged to a specific charge level in a short period of time.

The anionic strength of the toner mother particles can be increased through the toner mother particles containing a negatively chargeable charge control agent (specific examples include organic metal complexes and chelate compounds). The cationic strength of the toner mother particles can be increased through the toner mother particles containing a positively chargeable charge control agent (specific examples include pyridine, nigrosine, and quaternary ammonium salts). However, the toner mother particles do not need to contain a charge control agent as long as sufficient chargeability of the toner is ensured.

(Magnetic Powder)

The toner mother particles may contain a magnetic powder. Examples of materials of the magnetic powder that can be preferably used include ferromagnetic metals (specific examples include iron, cobalt, nickel, and alloys including at least one of the aforementioned metals), ferromagnetic metal oxides (specific examples include ferrite, magnetite, and chromium dioxide), and materials subjected to ferromagnetization (specific examples include carbon materials made ferromagnetic through thermal treatment). One magnetic powder may be used independently, or two or more magnetic powders may be used in combination.

[External Additive]

The toner mother particles have an external additive (specifically, a plurality of external additive particles) adhering to the surfaces thereof. The toner particles of the toner having the above-described basic features include the hydrotalcite particles as the external additive. Unlike internal additives, the external additive is not to be present inside of the toner mother particles but to be selectively present only on the surfaces of the toner mother particles. The external additive can for example be caused to adhere to the surfaces of the toner mother particles by stirring the toner mother particles and the external additive (particles) together. Strength of the connection between the toner mother particles and the external additive particles can be adjusted depending on stirring conditions (specific examples include stirring time and rotational speed for stirring), the particle diameter of the external additive particles, the shape of the external additive particles, and a surface condition of the external additive particles.

Particles obtained by pulverizing "KYOWAAD (registered Japanese trademark) 500PL", product of Kyowa Chemical Industry Co., Ltd. can for example be used as the hydrotalcite particles. The number average primary particle diameter of the hydrotalcite particles can be adjusted by changing pulverization conditions (specific examples include pulverization time and the number of pulverization passes). The "KYOWAAD 500PL", product of Kyowa Chemical Industry Co., Ltd., is represented by formula (1) described above in which $M^{2+}$ represents $Mg^{2+}$, $M^{3+}$ represents $Al^{3+}$, $A^{n-}$ represents $CO_3^{2-}$, x represents 0.25, and m represents 0.5. Since $A^{n-}$ represents $CO_3^{2-}$, n represents 2, and (x/n) represents 0.125 (=0.25/2).

In order that the hydrotalcite particles are used as external additive particles, the hydrotalcite particles preferably include a hydrotalcite base and a conductive layer present on a surface of the hydrotalcite base. The conductive layer is preferably a doped metal oxide layer such as an Sb-doped $SnO_2$ layer or an indium tin oxide layer. Particularly preferably, the conductive layer is an indium tin oxide layer. The indium tin oxide layer can be formed on the surface of the hydrotalcite base by treating the hydrotalcite base with indium tin oxide (ITO). Note that the conductive layer may be a layer containing a conductive material (specific examples include metals, carbon materials, and conductive polymers) other than doped metal oxides.

The hydrotalcite particles may be subjected to a surface treatment (for example, the negative chargeability imparting treatment). Examples of surface treatment agents that can be used include coupling agents (specific examples include silane coupling agents, titanate coupling agents, and aluminate coupling agents), silazane compounds (specific examples include chain silazane compounds and cyclic silazane compounds), and silicone oils (specific examples include dimethyl silicone oil). A surface of each conductive layer of the conductive hydrotalcite particles (specifically, hydrotalcite particles including conductive layers) may be subjected to the negative chargeability imparting treatment, or an uncovered region, which is not covered with the conductive layer, of the surface of the hydrotalcite base may be subjected to the negative chargeability imparting treatment. Particularly preferably, a silazane compound (specific examples include hexamethyldisilazane (HMDS)) is used as a surface treatment agent for the negative chargeability imparting treatment.

Additional external additive particles (also referred to below as "optional external additive particles") that are not the hydrotalcite particles may be caused to adhere to the surfaces of the toner mother particles. Examples of preferable optional external additive particles include silica particles and particles of a metal oxide (specific examples include alumina, titanium oxide, magnesium oxide, zinc oxide, strontium titanate, and barium titanate). Alternatively or additionally, particles of an organic acid compound such as a fatty acid metal salt (specific examples include zinc stearate) or resin particles may be used as external additive particles. Alternatively or additionally, composite particles, which are particles of a composite of a plurality of materials, may be used as external additive particles.

[Toner Production Method]

In order to produce the toner having the above-described basic features easily and favorably, for example, a method for producing the toner preferably includes a melt-kneading process, a pulverization process, a classification process, and an external additive addition process described below.

(Melt-Kneading Process)

The following describes an example of the melt-kneading process. In the melt-kneading process, toner materials including a binder resin and internal additives (for example, a polyester resin, a colorant, and a releasing agent) are mixed to obtain a mixture. A mixer (for example, an FM mixer) can be suitably used for mixing the toner materials. Additionally or alternatively, a masterbatch including a binder resin and a colorant may be used for the toner materials.

Subsequently, the mixture obtained as described above is melt-kneaded to obtain a melt-kneaded product. A twin-screw extruder, a three-roll kneader, or a two-roll kneader can be suitably used for melt-kneading the mixture.

(Pulverization Process and Classification Process)

The following describes examples of the pulverization and classification processes. First, the melt-kneaded product is cooled to solidify using a cooling and solidifying device such as a drum flaker. Subsequently, the resultant solidified product is coarsely pulverized using a first pulverizer. Thereafter, the resultant coarsely pulverized product is further pulverized using a second pulverizer. Subsequently, the resultant pulverized product is classified using a classifier (for example, an air classifier). Through the above, toner mother particles having a desired particle diameter are obtained.

(External Additive Addition Process)

In the external additive addition process, an external additive including at least hydrotalcite particles (for example, hydrotalcite particles and silica particles) is caused to adhere to the surfaces of the toner mother particles. The external additive can be caused to adhere to the surfaces of the toner mother particles by mixing the toner mother particles and the external additive using a mixer under conditions that prevent the external additive from being embedded in the toner mother particles.

Through the above-described processes, a toner including a number of toner particles can be produced. Note that non-essential processes may be omitted. In a situation in which a commercially available product can be used as is as a material, for example, a process of preparing the material can be omitted by using the commercially available product. In order to obtain a specific compound, a salt, an ester, a hydrate, or an anhydride of the compound may be used as a material thereof. Preferably, a large number of the toner particles are formed at the same time in order to produce the toner efficiently. Toner particles that are produced at the same time are thought to have substantially the same structure as one another.

EXAMPLES

The following describes examples of the present disclosure. Table 1 shows toners (electrostatic latent image developing toners) TA-1 to TA-21 and TB-1 to TB-6 according to Examples and Comparative Examples.

TABLE 1

| | Hydrotalcite particles | |
|---|---|---|
| Toner | Type | Amount [parts by mass] |
| TA-1 | HT-1 | 1.0 |
| TA-2 | HT-1 | 0.5 |
| TA-3 | HT-1 | 3.0 |
| TA-4 | HT-2 | 1.0 |
| TA-5 | HT-3 | 1.0 |
| TA-6 | HT-4 | 1.0 |
| TA-7 | HT-2 | 0.5 |
| TA-8 | HT-2 | 3.0 |
| TA-9 | HT-3 | 0.5 |
| TA-10 | HT-3 | 3.0 |
| TA-11 | HT-4 | 0.5 |
| TA-12 | HT-4 | 3.0 |
| TA-13 | HT-5 | 1.0 |
| TA-14 | HT-5 | 0.5 |
| TA-15 | HT-5 | 3.0 |
| TA-16 | HT-9 | 0.5 |
| TA-17 | HT-9 | 1.0 |
| TA-18 | HT-9 | 3.0 |
| TA-19 | HT-10 | 0.5 |
| TA-20 | HT-10 | 1.0 |
| TA-21 | HT-10 | 3.0 |
| TB-1 | HT-1 | 0.4 |
| TB-2 | HT-1 | 3.1 |
| TB-3 | HT-6 | 1.0 |
| TB-4 | HT-7 | 1.0 |
| TB-5 | HT-8 | 1.0 |
| TB-6 | None | — |

"HT-1" to "HT-10" in Table 1 respectively mean hydrotalcite particles HT-1 to HT-10 shown in Table 2. The hydrotalcite particles HT-1 to HT-10 are prepared according to a method described below. No hydrotalcite particles were used and titanium oxide particles were used instead of hydrotalcite particles for the toner TB-6. The amount (unit: parts by mass) of the hydrotalcite particles shown in Table 1 is relative to 100 parts by mass of the toner mother particles.

TABLE 2

| | Conductive layer | | Surface | | |
|---|---|---|---|---|---|
| Hydrotalcite particles | In compound [parts by mass] | Sn compound [parts by mass] | treatment HMDS [parts by mass] | Particle diameter [nm] | Volume resistivity [Ω · cm] |
| HT-1 | 2.0 | 0.20 | None | 300 | $1.0 \times 10^2$ |
| HT-2 | 2.0 | 0.20 | None | 80 | $1.0 \times 10^2$ |
| HT-3 | 2.0 | 0.20 | None | 1000 | $1.0 \times 10^2$ |
| HT-4 | 1.5 | 0.15 | None | 300 | $1.0 \times 10^5$ |
| HT-5 | 2.0 | 0.20 | 1.0 | 300 | $1.0 \times 10^2$ |
| HT-6 | 2.0 | 0.20 | None | 70 | $1.0 \times 10^2$ |
| HT-7 | 2.0 | 0.20 | None | 1100 | $1.0 \times 10^2$ |
| HT-8 | 1.2 | 0.12 | None | 300 | $1.0 \times 10^6$ |
| HT-9 | 1.5 | 0.15 | None | 80 | $1.0 \times 10^5$ |
| HT-10 | 1.5 | 0.15 | None | 1000 | $1.0 \times 10^5$ |

In Table 2, "In compound", "Sn compound", and "HMDS" mean as follows.

In compound: indium octylate

Sn compound: tin p-toluate

HMDS: hexamethyldisilazane

The amount (unit: parts by mass) shown with respect to each of "In compound", "Sn compound", and "HMDS" is relative to 10 parts by mass of the hydrotalcite base. "Particle diameter" shown in Table 2 is a number average primary particle diameter (unit: nm).

The following describes production methods, evaluation methods, and evaluation results of the toners TA-1 to TA-21 and TB-1 to TB-6 in the stated order. In evaluations in which errors might occur, an evaluation value was calculated by obtaining an appropriate number of measured values and calculating the arithmetic mean of the measured values in order to ensure that any errors were sufficiently small.

[Preparation of Materials]

(Synthesis of Polyester Resin)

A four-necked flask having a capacity of 2 L and equipped with a thermometer, a glass nitrogen inlet tube, a stirrer (a stainless steel stirring impeller), and a falling-type condenser (a heat exchanger) was charged with 55 parts by mole of ethylene glycol, 40 parts by mole of terephthalic acid, and 5 parts by mole of 1,2,4-benzenetricarboxylic acid anhydride. Subsequently, the flask was placed on a heating mantle. Subsequently, a nitrogen atmosphere (an inert atmosphere) was maintained in the flask with nitrogen gas introduced into the flask through the nitrogen inlet tube. Subsequently, the flask contents were heated up to 200° C. under stirring in the nitrogen atmosphere. The flask contents were then caused to undergo a polymerization reaction (polycondensation reaction) under stirring at 200° C. in the nitrogen atmosphere.

There was a loss in the amount of each of the monomers (specifically, the ethylene glycol, the terephthalic acid, and the 1,2,4-benzenetricarboxylic acid anhydride) during the polymerization reaction. Accordingly, the monomer in an amount equivalent to the loss was supplied into the flask. It is thought that the loss in the amount of the monomer was for example due to scattering or sublimation of the monomer. During the polymerization reaction, a small amount of a resin in the flask was collected to measure an acid value thereof. The polymerization reaction was stopped once the acid value of the resin in the flask reached 8 mgKOH/g. Thereafter, the flask contents were taken out, put in a stainless steel container (tray), and cooled to 25° C. under ambient environmental conditions, thereby obtaining a polyester resin.

(Preparation Method of Hydrotalcite Particles HT-1 to HT-10)

A fine hydrotalcite powder ("KYOWAAD 500PL", product of Kyowa Chemical Industry Co., Ltd.) was pulverized using a fluidized bed opposed jet mill ("100AFG", product of Hosokawa Micron Corporation) until hydrotalcite having a number average primary particle diameter shown in Table 2 was obtained. Thus, hydrotalcite base particles were obtained. Subsequently, 10 parts by mass of the thus obtained hydrotalcite base particles were dispersed in a liquid including an ITO-containing treatment agent to give a hydrotalcite dispersion. As the liquid including the ITO-containing treatment agent, a solution was used which was obtained by dissolving indium octylate and tin p-toluate, which were each in an amount shown in Table 2, in 90 parts by mass of a solvent mixture (a liquid obtained by mixing toluene and xylene at a mass ratio of 1:1). For example, in the preparation of the hydrotalcite particles HT-1, a solution of 2.0 parts by mass of indium octylate and 0.20 parts by mass of tin p-toluate in 90 parts by mass of the solvent mixture was used as the liquid including the ITO-containing treatment agent. For another example, in the preparation of the hydrotalcite particles HT-5, a solution of 2.0 parts by mass of indium octylate, 0.20 parts by mass of tin p-toluate, and a surface treatment agent (hexamethyldisilazane) in 90 parts by mass of the solvent mixture was used as the liquid including the ITO-containing treatment agent.

Subsequently, the hydrotalcite dispersion obtained as described above was subjected to a thermal treatment at 180° C. for 60 minutes under stirring to give dried hydrotalcite particles. The resultant hydrotalcite particles were agglomerated from the drying. The hydrotalcite particles were therefore subjected to deagglomeration. Subsequently, the hydrotalcite particles were classified. As a result, a number of hydrotalcite particles (specifically. ITO-treated hydrotalcite particles) were obtained. The thus obtained hydrotalcite particles HT-1 to HT-10 each included a hydrotalcite base and a conductive layer (specifically, an indium tin oxide layer) present on the surface of the hydrotalcite base. The hydrotalcite particles HT-5, which were surface-treated with a silazane compound (hexamethyldisilazane), were of stronger negatively chargeable character than hydrotalcite particles that were not surface-treated.

The number average primary particle diameter and the volume resistivity of the hydrotalcite particles HT-1 to HT-10 obtained as described above were measured. Table 2 shows the measurement results. The number average primary particle diameter of each of the hydrotalcite particles HT-1 to HT-10 was determined by taking a projection image of the hydrotalcite particles using a scanning electron microscope (SEM) and performing image analysis on the projection image. Specifically, equivalent circle diameters of a suitable number of primary particles in the projection image of the hydrotalcite particles were measured, and the number average of the measured equivalent circle diameters was determined as the number average primary particle diameter of the hydrotalcite particles. The image analysis was performed using image analysis software ("WinROOF", product of Mitani Corporation). The volume resistivity was measured according to a method described below.

<Volume Resistivity Measurement Method>

The volume resistivity of each of the hydrotalcite particles HT-1 to HT-10 was measured using an electrical resistance meter ("MCP-PD51", product of Mitsubishi Chemical Analytech Co., Ltd.). With respect to each of the hydrotalcite particles HT-1 to HT-10 (measurement targets), a sample of thickness M (unit: cm) was taken and loaded into a cylindrical metal cell. Subsequently, an upper electrode and a lower electrode having an electrode area S (unit: $cm^2$) were respectively placed above and below the sample in the cell such as to be in contact with the sample. The electrode area S is equivalent to an area of contact between the electrodes and the sample. Subsequently, a load of 5 kN was applied to the upper electrode. In the state described above, a voltage $V_0$ was applied between the electrodes and the resultant current I (unit: A) was used to calculate the volume resistivity (unit: Ω·cm) of the sample based on the following expression: volume resistivity=$(V_0/I)\times(S/M)$. The voltage $V_0$ was 100 V.

[Toner Production Method]

(Preparation of Toner Mother Particles)

An FM mixer ("FM-20", product of Nippon Coke & Engineering Co., Ltd.) was used to mix 100 parts by mass of a binder resin (the polyester resin synthesized as described above), 85 parts by mass of a magnetic powder (magnetite: "TN-15", product of Mitsui Mining & Smelting Co., Ltd.), 3 parts by mass of a first charge control agent ("ACRYBASE (registered Japanese trademark) FCA-207P", product of FUJIKURA KASEI CO., LTD., ingredient: a styrene-acrylic acid-based resin including a repeating unit derived from a quaternary ammonium salt), 1 part by mass of a second charge control agent (a nigrosine dye: "BONTRON (registered Japanese trademark) N-71", product of ORIENT CHEMICAL INDUSTRIES, Co., Ltd.), and 5 parts by mass of a releasing agent (an ester wax: "NISSAN ELECTOL (registered Japanese trademark) WEP-3", product of NOF Corporation) at a rotational speed of 2,000 rpm for 5 minutes.

Subsequently, the resultant mixture was melt-kneaded under conditions of a material feeding rate of 100 g/minute, a shaft rotational speed of 150 rpm, and a melt-kneading temperature (a cylinder temperature) of 120° C. using a twin-screw extruder ("PCM-30", product of Ikegai Corp.). Thereafter, the resultant kneaded product was cooled. After cooling, the kneaded product was coarsely pulverized using a pulverizer ("ROTOPLEX (registered Japanese trademark)", product of Hosokawa Micron Corporation) under a condition of a set particle diameter of 2 mm. Subsequently, the resultant coarsely pulverized product was finely pulverized using a pulverizer ("TURBO MILL T250", product of FREUND-TURBO CORPORATION). Subsequently, the resultant finely pulverized product was classified using an air classifier (a classifier using the Coanda effect: "ELBOW JET TYPE EJ-LABO", product of Nittetsu Mining Co., Ltd.). As a result, toner mother particles having a volume median diameter ($D_{50}$) of 8 μm were obtained.

(External Additive Addition Process)

Subsequently, an external additive was added to the toner mother particles obtained as described above. Specifically, 100 parts by mass of the toner mother particles, 0.8 parts by mass of positively chargeable silica particles ("AEROSIL (registered Japanese trademark) RA200", product of Nippon Aerosil Co., Ltd., content: dry silica particles rendered hydrophobic and positively chargeable through surface treatment, surface treatment agent: hexamethyldisilazane (HMDS) and aminosilane, number average primary particle diameter: approximately 12 nm), and the hydrotalcite particles of a type (a specified one of the hydrotalcite particles HT-1 to HT-10) and in an amount shown in Table 1 were mixed using an FM mixer ("FM-20", product of Nippon Coke & Engineering Co., Ltd.) at a rotational speed of 2,000 rpm for 5 minutes to cause the external additive to adhere to the surfaces of the toner mother particles. However, in the production of the toner TB-6, conductive titanium oxide particles ("EC-100", product of Titan Kogyo, Ltd., base: $TiO_2$ particles, coat layer: Sb-doped $SnO_2$, number average primary particle diameter: 300 nm, volume resistivity: 10 Ω·cm) were used instead of the hydrotalcite particles. The amount of the conductive titanium oxide particles that were added was 1.0 part by mass relative to 100 parts by mass of the toner mother particles.

For example, in the production of the toner TA-1, 100 parts by mass of the toner mother particles, 1.0 part by mass of the hydrotalcite particles HT-1, and 0.8 parts by mass of the positively chargeable silica particles (AEROSIL RA200) were mixed. For another example, in the production of the toner TB-6, 100 parts by mass of the toner mother particles, 1.0 part by mass of the conductive titanium oxide particles (EC-100), and 0.8 parts by mass of the positively chargeable silica particles (AEROSIL RA200) were mixed.

After the external additive addition, the resultant powder was sifted using a 200-mesh sieve (pore size: 75 μm). As a result, a toner (each of the toners TA-1 to TA-21 and TB-1 to TB-6 shown in Table 1) including a number of toner particles was obtained.

[Evaluation Methods]

Each of the samples (the toners TA-1 to TA-21 and TB-1 to TB-6) was evaluated according to methods described below.

(Preparation of First Image Forming Apparatus)

A monochrome printer ("FS-4020DN", product of KYOCERA Document Solutions Inc., photosensitive drum: amorphous silicon drum) was used as a first image forming apparatus. With respect to each of the toners TA-1 to TA-21 and TB-1 to TB-6 (evaluation targets), the toner was loaded into a development device and a toner container of the first image forming apparatus.

(Preparation of Second Image Forming Apparatus)

An image forming apparatus obtained by mounting a rubbing roller in a monochrome printer ("FS-4020DN", product of KYOCERA Document Solutions Inc., photosensitive drum: amorphous silicon drum) was used as a second image forming apparatus. The rubbing roller included a metal shaft and a urethane foam layer covering the metal shaft. The second image forming apparatus further included a motor for rotating the metal shaft of the rubbing roller. With respect to each of the toners TA-1 to TA-21 and TB-1 to TB-6 (evaluation targets), the toner was loaded into a development device and a toner container of the second image forming apparatus.

(Image Deletion)

A printing durability test was conducted in which a page including letters (JIS X 6931) was continuously printed on 5,000 successive sheets of paper (A4 size plain paper) using a specific image forming apparatus (specifically, the first image forming apparatus or the second image forming apparatus prepared as described above) in a standard temperature and standard humidity environment (temperature: 23° C., relative humidity: 50%). The image quality of the letters (specifically, decrease in recognizability of the letters due to image deletion) in the page (JIS X 6931) printed on the last sheet was evaluated by visual observation (first image deletion evaluation).

After the printing durability test, the image forming apparatus was put into a high temperature and high humidity environment (temperature: 35° C. relative humidity: 80%) and left to stand in the high temperature and high humidity environment for 24 hours. Subsequently, the image forming apparatus was used to print the aforementioned page (JIS X 6931) on paper (A4 size plain paper). The image quality of the letters (specifically, decrease in recognizability of the letters due to image deletion) in the page (JIS X 6931) printed on the paper was evaluated by visual observation (second image deletion evaluation).

With respect to each of the toners TA-1 to TA-21 and TB-1 to TB-6, the "first image deletion evaluation" and the "second image deletion evaluation" were performed using each of the first image forming apparatus and the second image forming apparatus. The toner was evaluated in terms of image deletion in accordance with the following standard.

A (excellent): Recognizability of the letters in the page printed in the high temperature and high humidity environment (temperature: 35° C., relative humidity: 80%) was comparable to recognizability of the letters in the page printed in the standard temperature and standard humidity environment (temperature: 23° C., relative humidity: 50%).

B (good): Recognizability of the letters in the page printed in the high temperature and high humidity environment (temperature: 35° C., relative humidity: 80%) was less than recognizability of the letters in the page printed in the standard temperature and standard humidity environment (temperature: 23° C., relative humidity: 50%). However, the letters in the page printed in the high temperature and high humidity environment (temperature: 35° C., relative humidity: 80%) were still recognizable.

C (poor): Some of the letters in the page printed in the high temperature and high humidity environment (temperature: 35° C. relative humidity: 80%) were unrecognizable.

(Dielectric Breakdown)

A printing durability test was conducted in which continuous printing at a coverage of 20% was performed on 5,000 successive sheets of paper (A4 size plain paper) using the first image forming apparatus in a high temperature and high humidity environment (temperature: 35° C., relative humidity: 80%). Subsequently, the first image forming apparatus was left to stand in the high temperature and high humidity environment (temperature: 35° C., relative humidity: 80%) for 24 hours. Subsequently, a printing durability test was conducted in which a white image was formed on 1,000 successive sheets of paper using the first image forming apparatus. Subsequently, each of the resulting 1,000 sheets of paper was observed to determine whether or not the image formed included any black spots corresponding to a period of a photosensitive drum cycle. Each of the toners TA-1 to TA-21 and TB-1 to TB-6 was evaluated in terms of dielectric breakdown in accordance with the following standard.

A (good): No black spots were observed in any of the 1,000 sheets of paper.

B (bad): Black spots were observed in at least one of the 1,000 sheets of paper.

(Fogging)

A white image was formed using the first image forming apparatus in a standard temperature and standard humidity environment (temperature: 23° C., relative humidity: 50%), and fogging density (FD) was measured. The fogging density (FD) was measured using a whiteness meter ("TC-6DS", product of Tokyo Denshoku CO., LTD.). Each of the toners TA-1 to TA-21 and TB-1 to TB-6 was evaluated in terms of fogging density (FD). The toner was evaluated as A (good) if the fogging density (FD) was less than or equal to 0.010. The toner was evaluated as B (bad) if the fogging density (FD) was greater than 0.010. The fogging density (FD) is equivalent to a value obtained by subtracting a reflection density of base paper (paper not printed on) from a reflection density of a blank portion of the paper printed on for the evaluation.

[Evaluation Results]

Table 3 shows results of the evaluations of the toners TA-1 to TA-21 and TB-1 to TB-6 in terms of image deletion, dielectric breakdown, and fogging. As for the evaluation in terms of image deletion, results obtained by using the first image forming apparatus are shown under the heading "Without rubbing", and results obtained by using the second image forming apparatus are shown under the heading "With rubbing".

TABLE 3

| | Toner | Image deletion | | Dielectric breakdown | Fogging |
|---|---|---|---|---|---|
| | | Without rubbing | With rubbing | | |
| Example 1 | TA-1 | B | A | A | A |
| Example 2 | TA-2 | B | A | A | A |
| Example 3 | TA-3 | A | A | A | A |
| Example 4 | TA-4 | B | A | A | A |
| Example 5 | TA-5 | B | A | A | A |
| Example 6 | TA-6 | B | A | A | A |
| Example 7 | TA-7 | B | A | A | A |
| Example 8 | TA-8 | A | A | A | A |
| Example 9 | TA-9 | B | A | A | A |
| Example 10 | TA-10 | A | A | A | A |
| Example 11 | TA-11 | B | A | A | A |
| Example 12 | TA-12 | A | A | A | A |
| Example 13 | TA-13 | A | A | A | A |
| Example 14 | TA-14 | A | A | A | A |
| Example 15 | TA-15 | A | A | A | A |
| Example 16 | TA-16 | B | A | A | A |
| Example 17 | TA-17 | B | A | A | A |
| Example 18 | TA-18 | A | A | A | A |
| Example 19 | TA-19 | B | A | A | A |
| Example 20 | TA-20 | B | A | A | A |
| Example 21 | TA-21 | A | A | A | A |
| Comparative Example 1 | TB-1 | C | B | A | A |
| Comparative Example 2 | TB-2 | A | A | A | B |
| Comparative Example 3 | TB-3 | C | B | A | A |
| Comparative Example 4 | TB-4 | C | B | A | A |
| Comparative Example 5 | TB-5 | B | A | B | A |
| Comparative Example 6 | TB-6 | C | C | A | A |

Each of the toners TA-1 to TA-21 (the toners according to Examples 1 to 21) had the above-described basic features. Each of the toners TA-1 to TA-21 included a plurality of toner particles each including a toner mother particle and an external additive adhering to a surface of the toner mother particle. The external additive included hydrotalcite particles. The hydrotalcite particles had a number average primary particle diameter of at least 80 nm and no greater than 1,000 nm (see Tables 1 and 2). The hydrotalcite particles had a volume resistivity of no greater than $1.0\times10^5$ Ω·cm (see Tables 1 and 2). The amount of the hydrotalcite particles was at least 0.5 parts by mass and no greater than 3.0 parts by mass relative to 100 parts by mass of the toner mother particles (see Table 1).

As indicated in Table 3, each of the toners TA-1 to TA-21 was able to form a high-quality image continuously over a long period of time.

What is claimed is:

1. A toner comprising a plurality of toner particles each including a toner mother particle and an external additive adhering to a surface of the toner mother particle, wherein the external additive includes hydrotalcite particles, the hydrotalcite particles have a number average primary particle diameter of at least 80 nm and no greater than 1,000 nm, the hydrotalcite particles have a volume resistivity of no greater than $1.0\times10^5$ Ω·cm, an amount of the hydrotalcite particles is at least 0.5 parts by mass and no greater than 3.0 parts by mass relative to 100 parts by mass of the toner mother particles, and the hydrotalcite particles include a hydrotalcite base and a conductive layer present on a surface of the hydrotalcite base.

2. The toner according to claim 1, wherein the conductive layer is an indium tin oxide layer.

3. The toner according to claim 1, wherein the toner is positively chargeable, and the hydrotalcite particles are negatively chargeable.

4. The toner according to claim 3, wherein the hydrotalcite particles are surface-treated with a silazane compound.

5. The toner according to claim 1, wherein the external additive includes no titanium oxide particles.

6. The toner according to claim 1, wherein the external additive further includes silica particles having a number average primary particle diameter of at least 5 nm and no greater than 30 nm.

* * * * *